United States Patent [19]

Farrar, Jr.

[11] 4,073,290

[45] Feb. 14, 1978

[54] PELVIC TRACTION BELT

[76] Inventor: Edward L. Farrar, Jr., 117 E. Copeland, Orlando, Fla. 32806

[21] Appl. No.: 687,642

[22] Filed: May 19, 1976

[51] Int. Cl.[2] ..... A61H 1/02

[52] U.S. Cl. ..... 128/75

[58] Field of Search ..... 128/75, 78, 84 R, 84 C, 128/83, 71

[56] References Cited

U.S. PATENT DOCUMENTS

| | | | |
|---|---|---|---|
| 1,628,369 | 5/1927 | McBurney | 128/71 |
| 3,561,434 | 2/1971 | Kilbey | 128/75 |
| 3,960,146 | 6/1976 | Albrecht | 128/75 |
| 4,002,165 | 1/1977 | Lind | 128/71 |

FOREIGN PATENT DOCUMENTS

| | | | |
|---|---|---|---|
| 93,445 | 3/1969 | France | 128/75 |

OTHER PUBLICATIONS

"Haines Pelvic Traction Belt", DePuy Fracture Appliances Catalogue, May 12, 1966.

*Primary Examiner*—John D. Yasko

*Attorney, Agent, or Firm*—Duckworth, Hobby & Allen

[57] ABSTRACT

A pelvic traction belt for transmitting a longitudinal traction force and a rotary traction force through the pelvic area to the spinal column of a human wearer located generally in the supine position. The pelvic traction belt includes a circumferential section for encircling the pelvic area of the wearer with the circumferential section having opposing end portions constituting the front of the circumferential section when being worn and a back portion intermediate the end sections. A traction tail is included as an integral part of the back portion of the circumferential section and depends generally perpendicular therefrom for communicating generally upwardly between the legs of the wearer for transmitting the longitudinal traction force and the rotary traction force through the pelvic area to the spinal column. Fasteners are included for removably securing the end portions of the circumferential section around the pelvic area of the wearer. A coupling device is attached to a distended end of the traction tail for coupling thereto a tension force emanating generally from above the supine wearer.

7 Claims, 4 Drawing Figures

PELVIC TRACTION BELT

BACKGROUND OF THE INVENTION

1. Field of the Invention

This invention relates to traction belts for coupling to the waist of a wearer for exerting through the pelvic area longitudinal and rotational traction forces on the spine.

2. Description of the Prior Art

Traction belts, such as the ones disclosed by Varco in U.S. Pat. No. 2,638,091, and Kilbey in U.S. Pat. No. 3,587,570, are well known in the art. Pelvic traction belts of this type are adapted to be placed around the waist for engaging the crest of the hip bones of the wearers. The old belts are fitted with extension straps to be connected to weights for providing a tension force against the spinal vertebrae through the pelvis of the patient. This tension force provides only a local immobilization of the central torso area and therefore leaves the other appendages of the patient free for other activities. Beard, in U.S. Pat. No. 3,572,327, discloses a belt of similar design. These pelvic traction belts employ tension straps on the side, the front or the posterior portions of the belt for applying longitudinal tension on the spinal column. However, all of these designs require that webbing straps be sewn to the circumferential section of the pelvic traction belt, a manufacturing process which is expensive, time consuming and unnecessarily subject to failure. After a period of nominal use the tension force pulling at the stitches causes the circumferential section of the pelvic traction belt to wrinkle, bunch up and bind, thus causing discomfort to the wearer. After additional periods of use the stitching begins to separate from the belt, later resulting in the ultimate separation of the strap from the circumferential belt.

Wiltrout, in U.S. Pat. No. 2,966,906, discloses a pelvic traction belt of advanced design which utilizes a plurality of straps communicating between different portions of a circumferential belt to provide additional strength thereto. The tension straps are coupled directly to the strengthening straps which communicate about the belt, thus alleviating the necessity for stitching the tension straps directly to the circumferential belt. However, this design requires complex procedures for fitting the circumferential belt and the harness to each individual patient. Furthermore, the excessive use of straps and harnesses on the rear of the belt provides bumps and lumps which produce substantial discomfort to some patients after prolonged periods in the reclining position.

Other traction devices are disclosed by Sloan in U.S. Pat. No. 590,531, Hien et al in U.S. Pat. No. 2,553,969, Burrus in U.S. Pat. No. 875,046, and Storms in U.S. Pat. No. 810,580.

In contrast to the prior art pelvic traction belts, the present invention applies both a longitudinal traction force and a rotary traction force to the human pelvis for transmission to the spinal column. These forces are incident upon the back of the pelvic region, thus reducing the friction between the patient's garments and the bed sheets. This design is more efficient in controlling the abnormal excessive curvature of the lumbar spine than the heretofore used belts, which employ side strap and back strap designs, because of the more even distribution of traction forces throughout the fibers of the new belt. Furthermore, the design of the present invention lends itself to an ease and economy of manufacture since the belt is constructed of essentially one piece of a lightweight material. This design lends itself to a reduction in stock and inventory since one or two sizes of the pelvic traction belt fit the greater majority of all patients. The present design also requires a minimum of adjusting when the belt is fitted to the patient, and not unimportantly minimizes the time required for disengagement of the belt from the traction force for allowing the patient to quickly care for other personal needs.

THE DRAWINGS

Other objects, features and advantages of this invention will be apparent from a study of the written description and the drawings in which.

SUMMARY OF THE INVENTION

A pelvic traction belt for transmitting a longitudinal traction force and a rotary traction force through the pelvic area to the spinal column of a human wearer located generally in the spine position. The pelvic traction belt includes a circumferential section for encircling the pelvic area of the wearer. The circumferential section has opposing end portions constituting the front of the circumferential section when being worn, and a back portion intermediate the end portions. Tail traction means form an integral part of the back portion of the circumferential section and depend generally perpendicularly therefrom for communicating generally upwardly between the legs of the wearer for transmitting the longitudinal traction force and the rotary traction force through the pelvic area to the spinal column. Fastening means are included for removably securing the end portions of the circumferential section around the pelvic area of the wearer. Coupling means are attached to a distended end of the tail traction means for coupling thereto a tension force emanating generally from above the supine wearer.

DETAILED DESCRIPTION OF THE PREFERRED EMBODIMENT

It should be understood at this point that the present invention should be not be limited in its application to the construction details and the illustrated parts in the accompanying drawings since this invention is capable of other embodiments and of being practiced or constructed in a variety of embodiments. Also, it must be understood that the terminology and descriptions employed herein are used solely for the purpose of describing the preferred embodiment and should not be construed as limitations on the operability of the invention.

Figure 1:
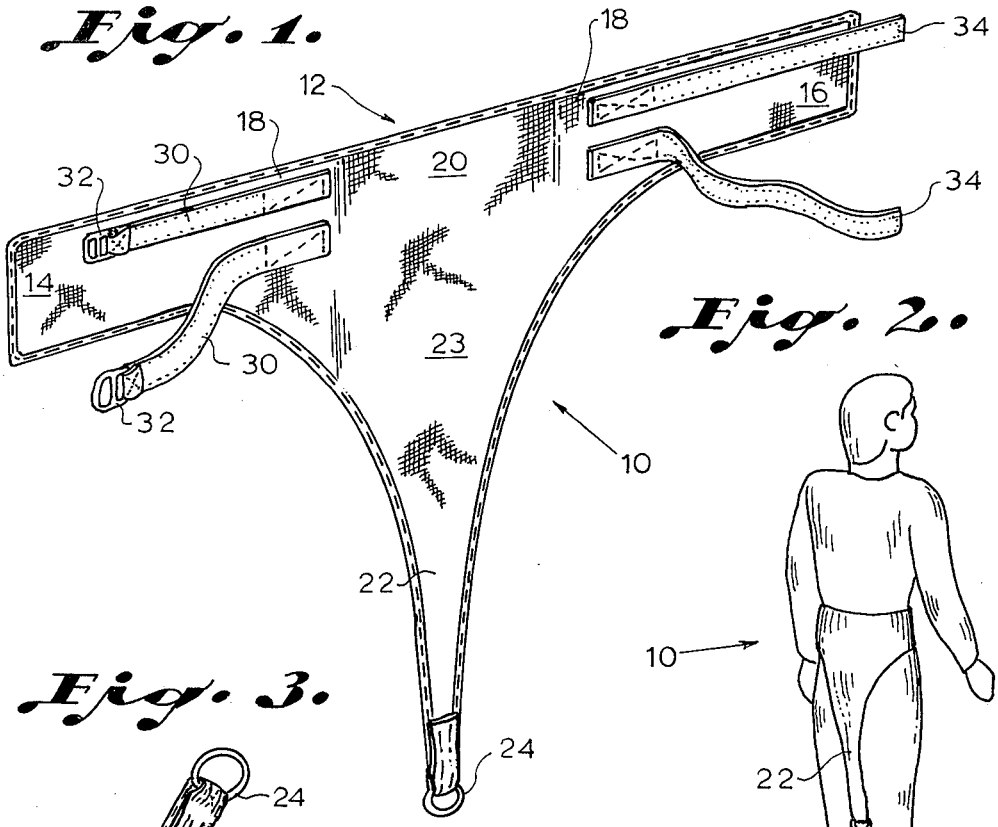
FIG. 1 is a perspective view of the back of the pelvic traction belt.
Figure 3:
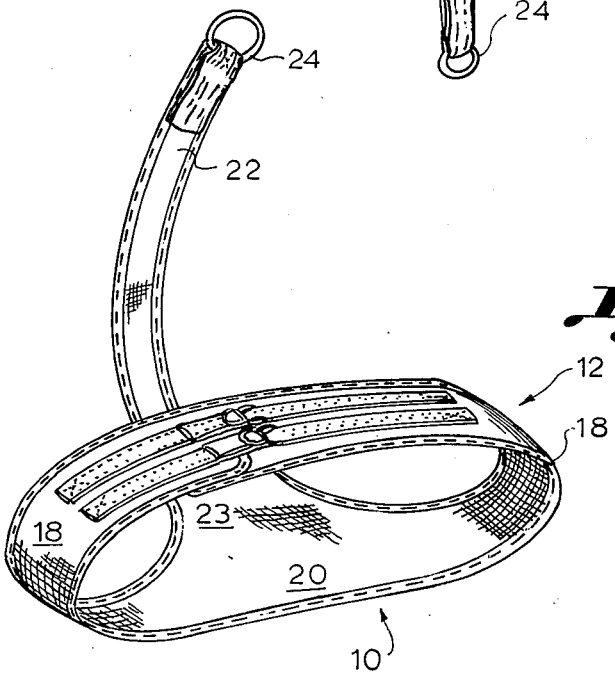
FIG. 3 illustrates the fastening means of the pelvic traction belt.

A pelvic traction belt, shown generally as 10 in FIGS. 1 and 3, is formed of a single, generally continuous piece of material having a characteristic T shape. The pelvic traction belt 10 includes a circumferential section 12 for encircling the torso, and specifically the pelvic bones of the wearer. The circumferential section 12 includes a first end portion 14 and an opposing second end portion 16 spaced therefrom along the top or bridge section of the T-shaped belt. The first end portion 14 and the second end portion 16 generally overlap adjacent to the abdomen of the wearer and constitute the front of the pelvic traction belt 10. The pelvic traction belt 10 further includes side sections 18 for communicating with the prominenles over the wearer's iliac bones and the crested portions thereof.

Figure 4:
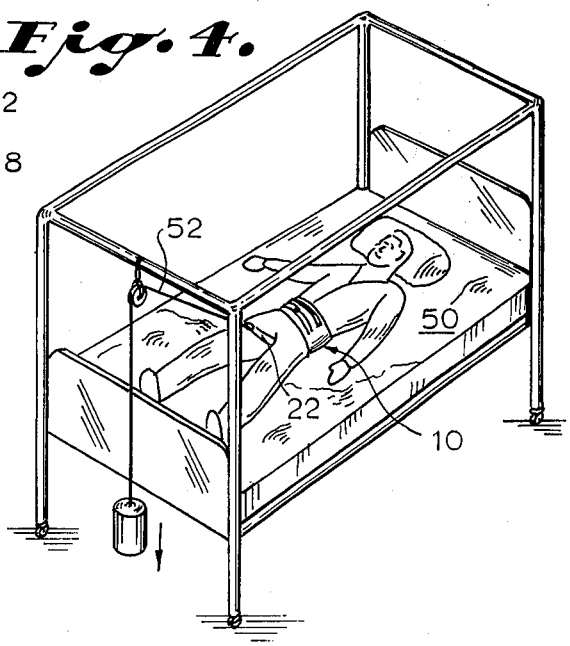
FIG. 4 illustrates the preferred method of applying a traction force upon the traction tail of the pelvic traction belt.

The pelvic traction belt further includes a back portion 20 intermediate the first end portion 14, the second end portion 16 and the side portions 18. The back portion 20 of the circumferential section 12 tapers in a triangular fashion into an integral traction tail portion 22 which depends generally perpendicularly therefrom for communicating generally upwardly between the legs of the wearer. An operative section 23 of the traction tail 22 extends from the back portion 20 of the circumferential section 12 for exerting a longitudinal and rotational traction force therebetween for transmission through the pelvic area to the spinal column of the wearer. Since the traction tail portion 22 is formed as a continuous part of the circumferential section 12, the traction forces are evenly exerted across the entire area of the lower back. The rotational traction force tends to effect a rotation of the lower portion of the spinal column about an axis communicating between the iliac crests. The traction tail 22 includes a large, generally triangular shaped section of material which covers the lower back, and particularly the sacrum, of the wearer. This large surface area of the traction tail 22 distributes the traction force more evenly, as compared with existing multiple strap designs, and thus decreases the force per unit area exerted upon the lower back of the wearer. Furthermore, the traction tail 22 also covers the buttocks or gluteus maximus muscles of the wearer for utilizing that tissue for cushioning the communication between the traction tail 22 and the sacrum of the wearer. The curved edges of the traction tail 22 are generally tapered to conform to the intersection between the gluteus maximus muscles and the legs of the wearer. A couplng ring 24 is attached to the apex of the traction tail 22 for coupling with a hook, or other such fastener, which exerts a tension force thereon. As shown in FIG. 4, this tension force emanates generally from above the feet of the wearer, that is, at an angle with respect to the longitudinal axis of the spinal chord of the wearer.

Figure 2:
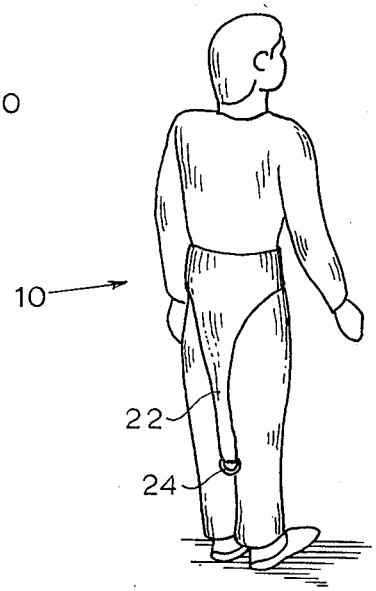
FIG. 2 illustrates a patient fitted with the pelvic traction belt.

The circumferential section 12 of the pelvic traction belt 10 is relatively wide for providing a large surface area in communication with the pelvic area of the wearer. The circumferential section 12 and the traction tail section 22 are formed from a singular piece of generally pliable material for deformably contouring to the general shape of the body of the wearer. Two straps 30 (fastening means) are aligned parallel to the circumferential section 12 and are attached thereto adjacent the side portion 18 and the first end portion 14 thereof. The straps 30 each have buckles 32, or other suitable fasteners, coupled at the distended ends thereof. Two additional straps 34 are similarly attached to the circumferential section 12 adjacent the side portions 18 and the second end portion 16 thereof. The distended ends of the straps 34 are adapted to couple with the buckles 32 to tightly restrain the circumferential section 12 of the pelvic traction belt 10 around the waist and pelvic area of the wearer, as illustrated in FIGS. 2 and 4. Other types of fasteners, such as VELCRO or its equivalent, could be attached directly to the first end portion 14 and the second end portion 16 of the circumferential section 12, thus allowing the belt fasteners to be eliminated.

After the circumferential section 12 has been fastened about the waist of the wearer, the traction tail 22 is then drawn over the buttocks and between the legs as shown in FIG. 2. The patient then assumes the supine position in a bed 50 and attaches a tension cable 52 to the ring coupling 24 at the distended end of the traction tail 22. The vector components of the tension force exerted by the tension cable 52 upon the ring coupling 24, the traction tail 22 and the curcumferential section 12 of the traction belt 10, include a longitudinal traction force which is generally parallel to the spinal column of the wearer and a generally upward traction force which is perpendicular to the longitudinal traction force and oriented to effect a rotation of the lower part of the spine about an axis communicating between the pelvic crests (or iliac crests). Since the traction tail 22 communicates with the buttocks of the wearer, the forces applied by the tension cable 52 exert a rotational traction force upon the buttocks and the sacrum which is transmitted by the pelvic bones as an additional tension force upon the lower spine of the patient. This additional tension force causes a flexion of the lower spinal column and a concomitant traction upon the lower spinal muscles, thus aiding in overcoming contractures of these muscles and ligaments. The rotational tension force has been demonstrated to effectively reduce the abnormal excessive curvature of the lumbar spine in a more efficient manner than the previously used side strap designs.

Since the circumferential section 12 of the pelvic traction belt 10 is formed from a single piece of soft deformable material, such as cotton fabric, there are fewer stitches and attached layers of material which may separate and tear due to the recurring motions of the patient. The simple design of the pelvic traction belt 10 also facilitates the rapid decoupling of the tension force, thereby allowing the patient rapidly to proceed with other body functions. Furthermore, the combination of the lightweight, single piece belt 10 and the single traction tail section 22 allows the patient to lie on either his right or left side with more comfort than with traction belts employing the multi-belt design, since the patient is not forced to rest his weight on one or more of the side mounted straps or fasteners. While the traction forces produced by the multi-belt designs are often unbalanced or reduced by the patient lying on one side, the traction force produced by the single belt design is not significantly effected by the reclining position of the patient.

I claim:

1. A pelvic traction belt for transmitting a longitudinal traction force and a rotary traction force through the pelvic area to the spinal column of a human wearer located generally in the supine position, said pelvic traction belt comprising:

a circumferential section for encircling the pelvic area of the wearer, said circumferential section having opposing end portions constituting a front of said circumferential section when being worn, said circumferential section having a back portion intermediate said end portion;

fastening means for removably securing said end portions of said circumferential section around the pelvic area of the wearer;

tail traction means comprising a substantially triangular configuration and including a base, said tail traction means through disposition of said base being integrally formed to said back portion of said circumferential section, said tail section means and said back portion formed from a single, generally continuous piece of material, said tail traction means further disposed to depend generally perpendicularly from said circumferential section for communicating generally upwardly between the legs of the wearer for transmitting said longitudinal traction force and said rotary traction force through the pelvic area to the spinal column, said longitudinal traction force being generally parallel to the spinal column of the wearer and said rotational traction force for effecting a rotation of the lower spinal column about an axis generally parallel to an axis communicating between the pelvic crests of the wearer, said tail traction means being formed to generally cover a broad section of the lower back adjacent the sacrum and to generally cover the buttocks of the wearer for cushioning the communication of said tail traction means with the sacrum and for providing a measure of lateral stability, thereby decreasing the force per unit area exerted thereon; and coupling means attached to a distended end of said tail traction means for coupling thereto a tension force emanating generally from above the lower extremities of the supine wearer.

2. The pelvic traction belt as described in claim 1 wherein said tail traction means is spaced from said circumferential section generally in a direction of said longitudinal traction force for exerting said rotary traction force through the pelvic area to the spinal column.

3. The pelvic traction belt as described in claim 2 wherein said tail traction means is generally adjacent to the sacrum of the lower back of the wearer for exerting said rotary traction force thereon.

4. The pelvic traction belt as described in claim 1 wherein said circumferential section is relatively wide for encircling the pelvic area of the wearer generally adjacent the iliac bones and the crests thereof.

5. The pelvic traction belt as described in claim 4 wherein said circumferential section and said tail traction means are formed from a lightweight pliable material for deformably contouring to the general shape of the body of the wearer.

6. The pelvic traction belt as described in claim 4 wherein said fastening means comprise a plurality of straps and buckles for coupling thereto, said straps being spaced generally along the width of said circumferential section for exerting an even securing force thereon.

7. A pelvic traction belt for transmitting a longitudinal traction force and a rotational traction force through the pelvic area to the spinal column of a human wearer located generally in the supine position, said pelvic traction belt comprising:

a circumferential section for encircling the pelvic area of the wearer, said circumferential section having opposing end portions constituting the front of said circumferential section when being worn, said circumferential section having side portions for engaging the pelvic crests, said circumferential section having a back portion intermediate its ends;

fastening means for removably securing said opposing end portions of said circumferential section around the pelvic area of the wearer;

longitudinal traction means for exerting said longitudinal traction force on said back portion of said circumferential section, said longitudinal traction force being generally parallel with the spine of the wearer;

rotation traction means, spaced from said circumferential section generally in a direction of said longitudinal force, for exerting a generally upward force on the iliac bones of the wearer;

said longitudinal traction means and said rotation traction means defined by a tail traction means comprising a substantially triangular configuration and including a base, said tail traction means through disposition of said base being integrally formed to said back portion of said circumferential section, said tail traction means and said back portion formed from a single, generally continuous piece of material, said tail traction means being formed to generally cover a broad section of the lower back adjacent the sacrum and to generally cover the buttocks of the wearer for cushioning the communication of said tail traction means with the sacrum; and coupling means attached to said longitudinal traction means and said rotation traction means for coupling thereto a tension force having longitudinal and upward components, said tension force emanating generally from above the lower extremities of said supine wearer.

* * * * *